United States Patent [19]

Randall et al.

[11] Patent Number: 4,726,551

[45] Date of Patent: Feb. 23, 1988

[54] BABY BOTTLE HOLDER

[75] Inventors: Jill A. Randall; William C. Randall, both of Chanhassen, Minn.

[73] Assignee: JB&J, Inc., Chanhassen, Minn.

[21] Appl. No.: 932,672

[22] Filed: Nov. 20, 1986

[51] Int. Cl.[4] ..... A47D 15/00

[52] U.S. Cl. ..... 248/102; 5/431; 5/503; 248/105

[58] Field of Search ..... 248/105, 102, 104, 103, 248/106, 107; D24/48; 5/503, 508, 431, 424

[56] References Cited

U.S. PATENT DOCUMENTS

| | | | |
|---|---|---|---|
| 918,565 | 4/1909 | Malpass | 248/105 |
| 2,451,718 | 10/1948 | Corrao . | |
| 2,460,308 | 2/1949 | Pribil | 5/424 X |
| 2,475,923 | 7/1949 | Suich . | |
| 2,526,121 | 10/1950 | Curry et al. | 248/102 |
| 2,552,844 | 5/1951 | Clinehens . | |
| 3,269,621 | 8/1966 | Dishart | 5/424 X |
| 3,584,818 | 6/1971 | Essman . | |
| 3,620,491 | 11/1971 | Baclit | 248/106 |
| 3,905,571 | 9/1975 | Lombardo | 248/102 |
| 4,405,106 | 9/1983 | Adler | 248/102 |

*Primary Examiner*—J. Franklin Foss
*Assistant Examiner*—David L. Talbott
*Attorney, Agent, or Firm*—Merchant, Gould, Smith, Edell, Welter & Schmidt

[57] ABSTRACT

This baby bottle holder enables a baby to feed from a bottle unassisted. Primarily, it consists of a pillow with a body wrap attached that includes flaps for securing it to the baby. It also includes a bottle holder block attached to one flap, which is provided with an elastic strap that holds and retains the baby bottle.

5 Claims, 5 Drawing Figures

FIG. 1
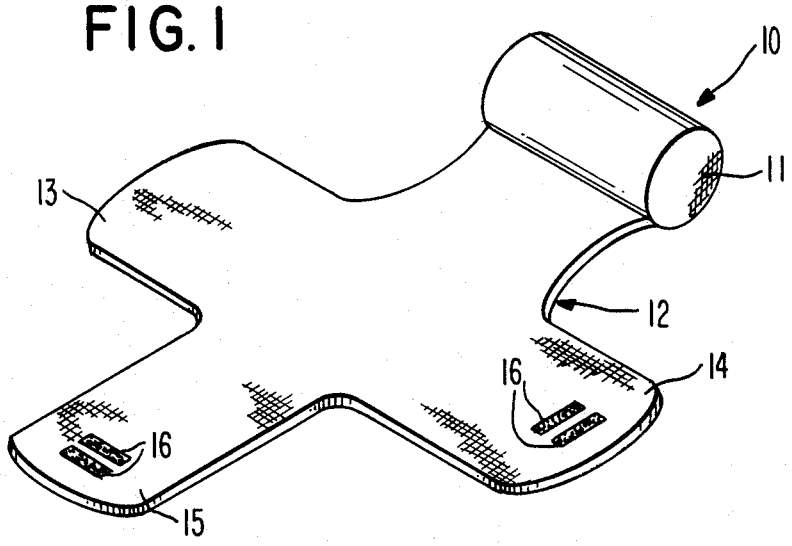
FIG. 2
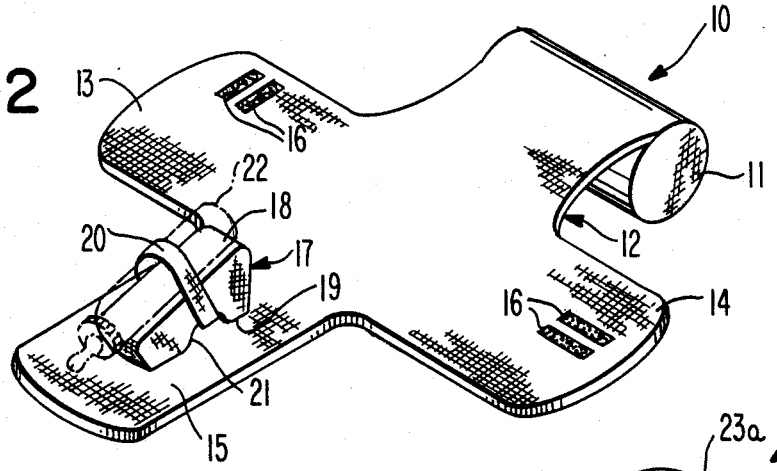
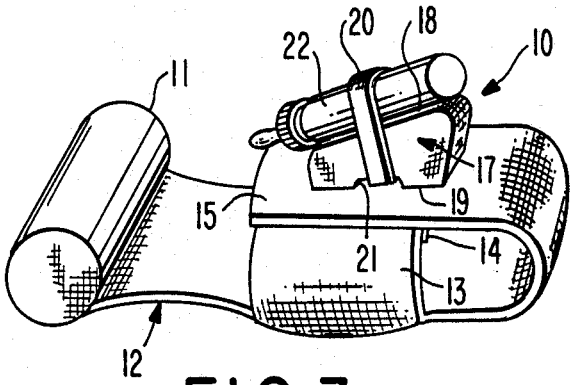
FIG. 3
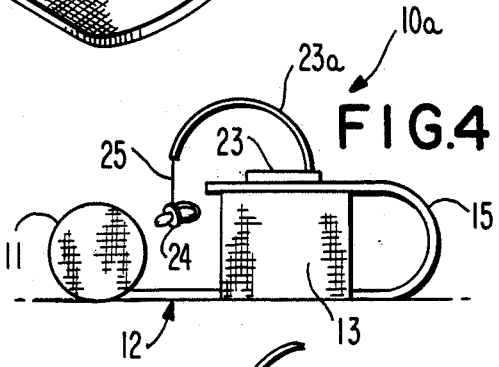
FIG. 4
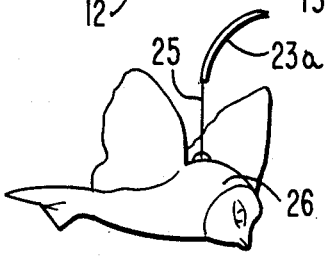
FIG. 5

BABY BOTTLE HOLDER

BACKGROUND OF THE INVENTION

1. Field of the Invention

This invention relates to infant apparel, and more particularly, to a baby bottle holder.

2. Description of Prior Art

Bottle holders have been devised and are of many types. The baby bottle holder in accordance with the present invention, has been devised to enable a baby to drink from a baby bottle without assistance.

The principal object of this invention is to provide a baby bottle holder, which will be unique in design, in that it will be composed of a cloth covered foam pillow having an attached cloth body wrap, and the design eliminates the need for a baby bottle to be held by an adult when feeding the baby, thus, enabling busy parents the freedom to perform other tasks while still watching the baby.

Another object of this invention is to provide a baby bottle holder, which will be so designed, as to have an appropriately angled baby bottle holder employing a cloth covered elastic band to retain and hold the bottle, and the body wrap will include flap means and velcro fastener means for securement to the baby, thus, preventing the need for buttons, snaps or other hard fasteners that could poke the baby or be pulled off.

A further object of this invention is to provide a baby bottle holder, which will be of such design, as to keep the baby warm and comfortable while drinking or feeding from the bottle, and the holder positions the bottle at the proper angle, so as to avoid air from entering the baby's stomach.

SUMMARY OF THE INVENTION

A baby bottle holder, comprising a cloth covered foam pillow with an attached cloth body wrap, and the body wrap includes a bottle holder block for retaining the bottle at the correct angle to prevent air from entering the stomach of the baby. The design further includes flap means with velcro fasteners for securing the holder to a baby.

BRIEF DESCRIPTION OF THE DRAWINGS

FIG. 1 is a top perspective view of the present invention;

FIG. 2 is a bottom perspective view of the invention, showing a baby bottle in place and in phantom lines;

FIG. 3 is a perspective view of the invention, shown in the fitted position with the bottle in place;

FIG. 4 is a side view of a modified form of the invention, shown in elevation, and FIG. 5 is a fragmentary side view of a typical toy, shown in elevation, which may be attached to the embodiment of FIG. 4.

DETAILED DESCRIPTION

Accordingly, a holder 10 is shown to include a cloth covered foam pillow 11, which is cylindrical in this instance. One end of a cloth body wrap 12 is fixedly secured to the outer periphery of pillow 11 longitudinally, in a suitable manner, (not shown). Three extending and integrally attached flaps 13, 14, and 15, are provided on body wrap 12 and include velcro fasteners 16 fixedly secured thereto, for fastening body wrap 12 to a baby, (not shown). A bottle holder block 17 fabricated of a suitable plastic, includes an angled top surface 18 and its bottom surface 19 is suitably secured to the bottom of flap 15, in a manner, (not shown). A cloth covered elastic strap 20 is secured in a suitable manner, (not shown), in a cut-out opening 21 in the bottom surface 19, and provides the means of holding and retaining a baby bottle 22.

In use, holder 10 is spread open on a convenient surface and the baby is positioned on its back with its head on the pillow 11. The flap 13 is pulled around the baby's right side and the left flap 14 is pulled over the baby's chest from the left side to the right side, and then fastened to flap 13 with the velcro fasteners 16. After the above, flap 15 is pulled up between the baby's legs and is fastened to flap 14 which is centered on the baby's chest. The baby bottle 22 is then placed within the elastic strap 20.

Looking now at FIGS. 4 and 5, a modified form of holder **10*a* is shown to include the same elements described of 10, with the exception, that the bottle holder block 17 is detachable from a mount 23 when not in use, and a spring arm 23*a* is attached, having a pacifier 24 on a cord 25, or a toy 26 may be substituted for the pacifier 24**.

In use, the function of **10*a* remains the same as 10, with the exception, that the holder block 17 is detachable for the placement of pacifier 24 or toy 26**.

While various changes may be made in the detail construction, such changes will be within the spirit and scope of the present invention, as defined by the appended claims.

What we now claim is:

1. A baby bottle holder for use by a baby, comprising a pillow serving as a head support for the head of the baby, a warming body wrap fixedly secured to one end of said pillow, and a bottle holder block means secured to said body wrap for positioning the baby bottle at an angle for the feeding of the baby.

2. A baby bottle holder as set forth in claim 1 wherein said warming body wrap is of cross-shaped configuration and is provided with a left side flap, a right side flap, and an end flap, said end flap being aligned longitudinally with said pillow, and said right flap and said left flap engage over the chest of said baby such that, in use, said end flap is received between the legs of said baby and said right flap, said left flap, and said end flap are fastened to each other by fasteners secured to said right flap, said left flap, and said end flap.

3. A baby bottle holder as set forth in claim 2 wherein said bottle holder block means is secured fixedly at a bottom surface to said end flap, and a top surface of said block means is angularly inclined and receives a baby bottle that is held to said top surface by an elastic band fixedly secured to said bottom surface.

4. A baby bottle holder and warming wrap for use in feeding a baby, comprising:

a cloth-covered pillow;

a cloth warming body wrap formed in the shape of a cross, having a top flap attached to said pillow, a left flap, a right flap, and an end flap;

A bottle holder block attached at the bottom surface to said body wrap having a top surface angled to support a baby bottle and having an elastic strap attached to said block positioned to secure the baby bottle to said block; and so that in use, the baby bottle holder and warming wrap is spread upon a convenient surface and the baby is positioned on its back with its head on said pillow with the left flap pulled around one side of the baby's chest, the right flap pulled around the other side of the baby's chest, and the end flap is pulled between the baby's legs, said flaps being adjustably fastened according to the size of the baby such that the baby bottle holder is positioned above the baby's chest in such a position as to present the baby bottle to the baby's mouth for feeding.

5. An apparatus comprising:

a cloth-covered pillow;

a cloth warming body wrap formed in the shape of a cross having a top flap attached to said pillow, a left flap, a right flap and an end flap; and a bottle holder block removeably attached at a bottom surface to said end flap of said body wrap, said bottle holder block having a top surface angled to support a baby bottle such that in use, the left flap and right flap are wrapped around the baby's chest and the end flap is pulled between the legs of the child and secured to the left flap and side flap such that the baby bottle block is positioned to present a baby bottle at an angle for feeding so as to avoid air from entering the baby's stomach.

* * * * *